US006305434B1

(12) United States Patent
Speich

(10) Patent No.: US 6,305,434 B1
(45) Date of Patent: Oct. 23, 2001

(54) GRIPPER AND WEFT INSERTION DEVICE FOR A RAPIER LOOM

(75) Inventor: Francisco Speich, Gipf-Oberfrick (CH)

(73) Assignee: Textilma AG, Hergiswil (CH)

( * ) Notice: Subject to any disclaimer, the term of this patent is extended or adjusted under 35 U.S.C. 154(b) by 0 days.

(21) Appl. No.: 09/700,805

(22) PCT Filed: Mar. 8, 1999

(86) PCT No.: PCT/CH99/00104

§ 371 Date: Nov. 20, 2000

§ 102(e) Date: Nov. 20, 2000

(87) PCT Pub. No.: WO99/60193

PCT Pub. Date: Nov. 25, 1999

(30) Foreign Application Priority Data

May 18, 1998 (DE) ..... 298 08 997 U

(51) Int. Cl.[7] ..... D03D 47/23; D03D 47/12

(52) U.S. Cl. ..... 139/448

(58) Field of Search ..... 139/438, 448

(56) References Cited

FOREIGN PATENT DOCUMENTS

| | | | |
|---|---|---|---|
| 298 08 997 | * | 4/1998 | (DE) . |
| 0 690 160 | * | 4/1981 | (EP) . |
| 299 553 | | 1/1989 | (EP) . |
| 624 671 A1 | | 11/1994 | (EP) . |
| 2 059 455 | * | 4/1981 | (GB) . |

* cited by examiner

*Primary Examiner*—Andy Falik
(74) *Attorney, Agent, or Firm*—Cohen, Pontani, Lieberman & Pavane

(57) ABSTRACT

The gripper comprises a housing (1), an actuator (2), a thread clamp (3) and a connecting section (11) for a gripper band. The actuator can be operated electrically and controlled via induction coils (71) in such a way that the clamping force and the clamping cycle of the thread clamp are adjusted in accordance with the physical and/or textile data of the weft to be inserted.

5 Claims, 3 Drawing Sheets

GRIPPER AND WEFT INSERTION DEVICE FOR A RAPIER LOOM

BACKGROUND OF THE INVENTION

1. Field of the Invention

The invention relates to a gripper for a gripper weaving machine and to a weft insertion device with a gripper.

2. Discussion of the Prior Art

To insert a weft thread, either one gripper is used for leading the weft thread through the shed or a feed gripper and pick-up gripper are employed, the weft thread being transferred from the feed gripper to the pick-up gripper inside the shed. The grippers have thread clamps which are controlled positively, that is to say forcibly, outside the shed in the first-mentioned version and inside the shed in the second version. For this purpose mechanical or electromechanical means (GB 2, 059 455 A; EP 0 690 160 A) are employed, the operating element for opening or closing the thread clamp being arranged outside or below the shed. Particularly in the case of thread transfer inside the shed, this results in essentially the following disadvantages.

If mechanical means are used, the operating element must be introduced between the warp threads in order to operate the thread clamp.

If electromagnetic means are used, the trigger magnet must be arranged outside the shed. The airgap between the armature and magnetic core consequently becomes large, and because of this a higher field strength has to be generated, that is to say a winding with a greater number of ampere-turns is required. Since this trigger magnet is capable of slow-action switching, this results in a reduction in the speed of the weaving machine.

In the case of thread transfer inside the shed, the travels of the grippers intersect in the transfer region. That is to say, thread transfer takes place while the feed gripper and the pick-up gripper are still in motion. The activation of the thread clamp takes place at this moment, during which the operating element exerts pressure on the gripper. This results in a greater load and higher wear on the elements involved in operating the thread clamp, such as the gripper band or gripper rod or the batten and band guide or rod guide. Moreover, as a result of pressure being exerted in this way, the band gripper is pressed against the warp threads, thus causing breaks in the warp threads. For this reason, the gripper band and its guides have to be reinforced. As a consequence of this, the moved masses become greater, thus contradicting the requirement for masses which are as low as possible and therefore a reduction in the rotational speed of the weaving machine. It must also be taken into account that inside the shed, because of the high rate of production, the grippers may oscillate in the transfer region and collide with the operating elements. Special measures therefore become necessary in order as far as possible to reduce oscillations with such a frequency and amplitude.

As is known, the clamping force is predetermined by the type of thread. In both the mechanical and the electromechanical control of the thread clamp, therefore, the clamping force has to be set accordingly. For weaving with different types of thread, controls of this type prove at the very least to be restrictive, because, on the one hand, an average clamping force has to be fixed by means of tests and, on the other hand, adaptation of the clamping force while the weaving machine is in operation, and particularly along the path between the operating elements, is not possible and is therefore not provided.

The embodiments described above also have the disadvantage that each point of influence is assigned an arrangement of operating elements for controlling the thread clamp, specifically:

a) feed gripper: activation in the shed center, b) pick-up gripper: activation in the shed center, c) feed gripper: activation of the thread read-in on the insertion side, d) pick-up gripper: thread release on the catching side, and e) feed gripper: activation of venting on the insertion side.

Up to five arrangements of operating elements are therefore necessary, which are to be activated individually.

This results in the following disadvantages:

1) maintenance of up to five arrangements;

2) high failure rate;

3) drop in performance; and 4) high cost outlay.

The known versions are therefore unsuitable for the individual control of the thread clamps, particularly along the path between the operating elements.

The nearest prior art to the invention may be gathered from the exemplary embodiment of FIG. 17 of EP 0 690 160A. There, a gripper is shown and described, which contains in the housing of the gripper an actuator designed as a piezoelectric element. The expansion of the piezoelectric actuator when a voltage is applied serves for closing the thread clamp, that is to say for bringing the moveable clamping part to bear on the fixed clamping part. The contraction of the piezoelectric actuator in the currentless state serves for opening the thread clamp, that is to say for easing the moveable clamping part from the fixed clamping part by venting. Since the force provided during the contraction of the piezoelectric actuator is low, a prestress of the moveable clamping part against the fixed clamping part is counterproductive and therefore harmful and is to be avoided. In this thread clamp, only two positions of the clamp are possible, that is to say "open" or "closed" but no first holding force as a result of a prestressing of the moveable clamping part against the fixed clamping part. In the event of a power failure, the thread clamp opens automatically and releases the weft thread. An individual control of the magnitude of the force of the piezoelectric actuator cannot be seen. The complexity and size of electromagnetic drives deters a person skilled in the art from installing in the gripper housing.

SUMMARY OF THE INVENTION

The object of the invention is to improve a gripper of the type mentioned in order to avoid the disadvantages described.

Since the moveable clamping part bears with prestress on the immovable clamping part, this ensures that the weft thread is received reliably and held securely, specifically even if there were to be a power failure. Moreover, due to the prestress on the clamping part, the holding force of the actuator also does not need to be excessive, because the entire clamping force is composed of the holding force A and of the clamping force B of the actuator. An actuator with lower power can therefore be used. Nevertheless, the release force, which exceeds the holding force in the opposite direction, ensures that the clamp is opened reliably, and this opening operation may likewise take place again in two stages, specifically, first, by the clamping force on the actuator being switched off, so that the weft thread is held solely by the clamping force of the moveable clamping part, and then, further, by a release force additionally being applied, which lifts off the moveable clamping part from the fixed clamping part and opens a gap for cleaning. Moreover, the actuator arranged in the gripper can be adjusted to the requirements of the weaving operation in terms of time and force in a highly sensitive way over the entire weaving cycle. This is very important, in particular, when the pattern of the woven cloth changes continuously and weft threads of varying thickness and quality have to be inserted.

The thread clamp of the gripper is controlled positively, that is to say without forces acting from outside, by means of an actuator arranged in the gripper, so that any load on the gripper head, the gripper guide and the warp threads is avoided. Readjustments and repairs to the gripper elements may therefore largely be dispensed with. Breaks in the warp threads are avoided, with the result that the operating costs are lowered considerably and the weaving output is increased considerably. The thread clamp can be influenced weft by weft, while the weaving machine is in operation and within a weaving cycle, in accordance with the physical and weaving data of the weft thread to be inserted. The desired value of the clamping force of the thread clamp is set and regulated by means of the control.

In the course of the weft insertion cycle, the following functions are performed by the thread clamp:

1. the feed gripper takes over the weft thread from the thread feed;
2. transports the weft thread into the shed;
3. the weft thread is transferred from the feed gripper to the pick-up gripper approximately in the shed center;
4. at the end of the insertion operation, the thread clamp of the pick-up gripper releases the weft thread;
5. the thread clamps are vented for cleaning; and
6. if necessary, the clamping force of the thread clamps is changed.

The thread clamps for the feed gripper and the pick-up gripper are essentially of similar design, with the result that the actuators are activated by means of the same control device. The production costs are thereby reduced considerably. By transformers being used in order to operate the thread clamp, the action of force on the grippers is avoided. By virtue of these measures, it is possible to operate a gripper weaving machine at up to 1000 revolutions per minute, with different yarns, such as zero twist or knub yarn, being processed simultaneously.

BRIEF DESCRIPTION OF THE DRAWINGS

The invention is explained below with reference to the accompanying drawings in which.

DETAILED DESCRIPTION OF THE PREFERRED EMBODIMENTS

Figure 1:
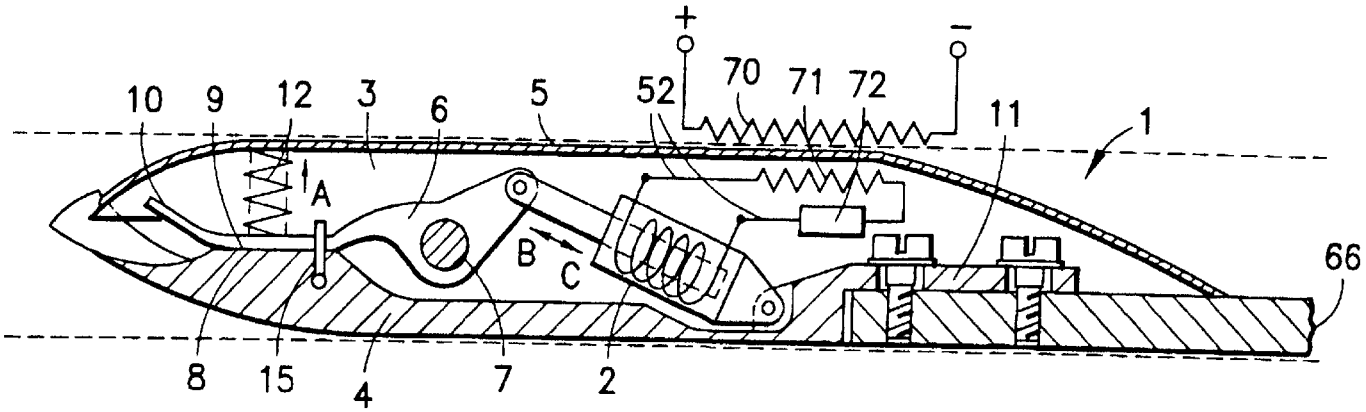
FIG. 1 shows a first embodiment of a gripper according to the invention.

Reference is made to FIG. 1 which shows one embodiment of a gripper according to the invention. The gripper contains a housing 1, an electromagnet 2 and a thread clamp 3. The housing 1 consists of a basic body 4 and of a cover part 5 which are connected to one another by means not illustrated. The electromagnet 2 is arranged, on one side, on the basic body 4. The thread clamp 3 comprises a clamping lever 6 which is designed as a two-armed lever and is arranged pivotably on a shaft 7, and a clamping surface 8 formed on the basic body 4. One lever arm has a clamping portion 9, which co-operates with the clamping surface 8 formed on the basic body 4, and is, at the free end, an angled portion 10 which, together with the basic body 4, forms an entry gap for a weft thread (not illustrated). At the end facing away from the entry side of the gripper, a connecting portion 11 for a transport unit is formed on the basic body 4. Furthermore, a spring 12 is provided, in order to prestress the clamping portion 9 against the clamping surface 8. Moreover, the gripper is equipped with a stop member 15 for the weft thread. In order to generate the translational movement for operating the clamping lever, a linear motor or a servomotor may be employed. If drive means of this type are used, the clamping lever 6 is advantageously coupled to the drive shaft of the motor.

Figure 2:
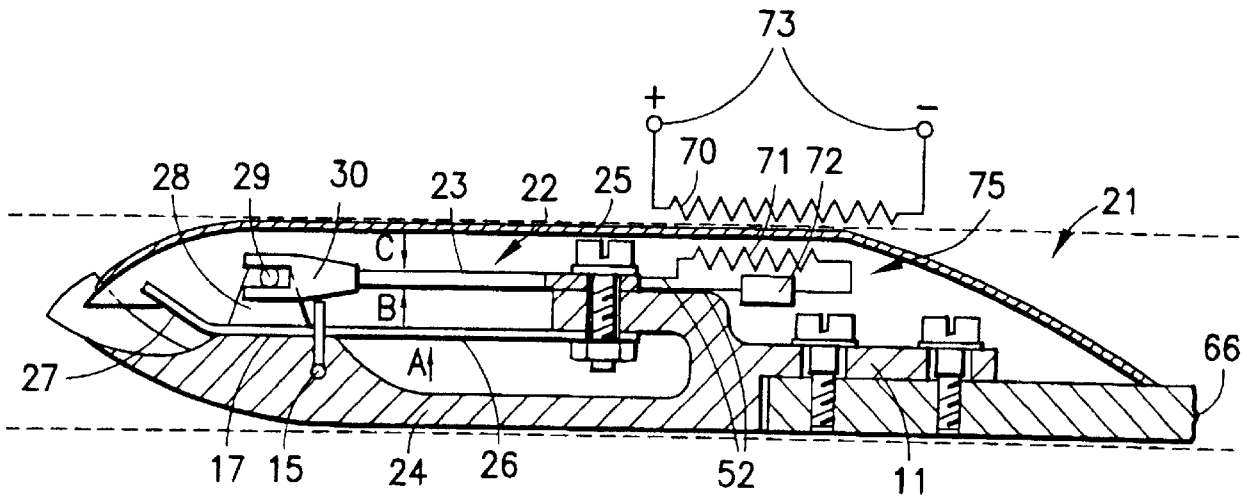
FIG. 2 shows a second embodiment of a gripper according to the invention.

In the embodiment according to the invention, as shown in FIG. 2, the gripper contains a housing 21, a thread clamp 22 and a piezoelectric quartz element 23. The housing 21 consists of a basic body 24 and a cover part 25. The thread clamp 22 comprises a strip-like clamping part 26, which consists of a resilient material, and a clamping portion 17 formed on the basic body 24. The clamping part 26 is fastened at one end to the basic body 24 and at the other end is provided with an angled portion 27 which forms with the basic body 24 an entry gap for a weft thread which is not illustrated. The clamping part 26 is provided with an extension 28 and a pin 29 which projects transversely to the extension 28. The piezoelectric quartz element 23 is fastened, on one side, to the basic body 24 and, on the other side, is provided with a coupling part 30 which is in engagement with the pin 29. At the end facing away from the entry side of the gripper, the connecting portion 11 for the transport unit is formed on the basic body 24.

Figure 3:
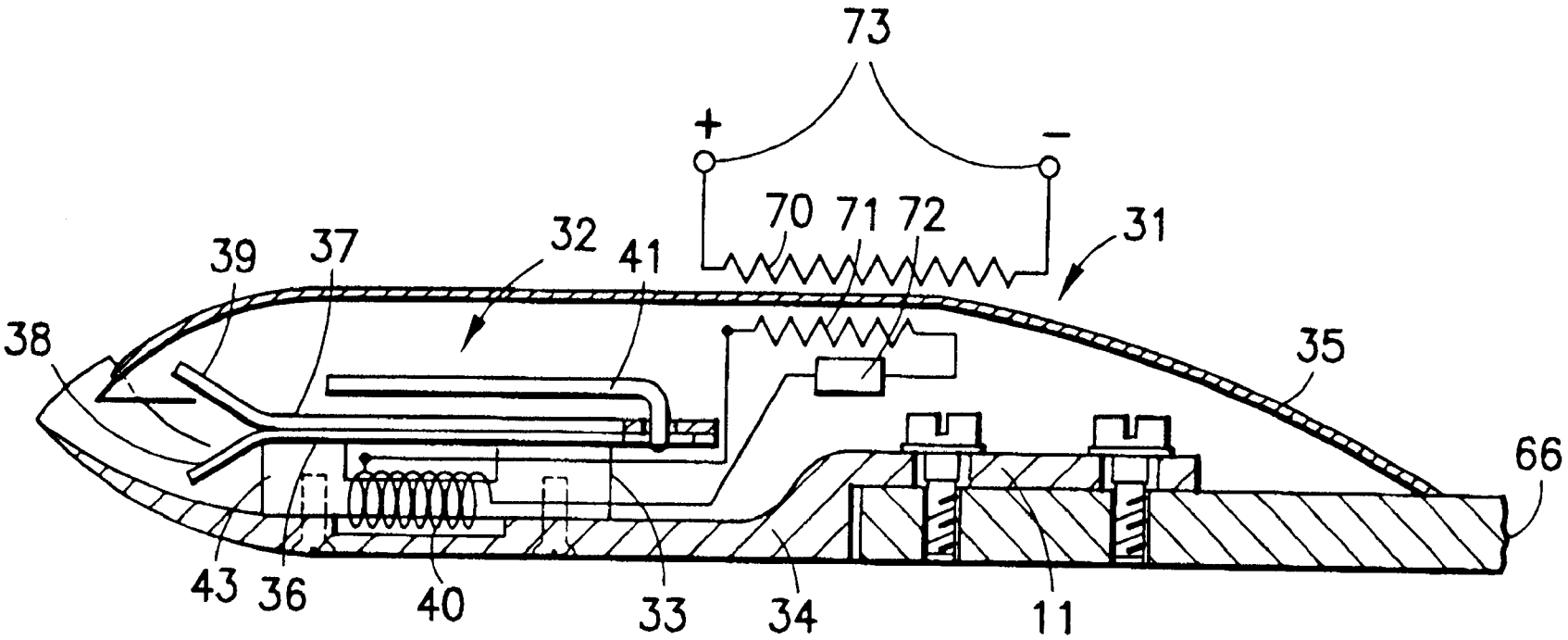
FIG. 3 shows a third embodiment of a gripper according to the invention.

The embodiment according to the invention, as shown in FIG. 3, differs from that of FIG. 1 in the design and arrangement of the electromagnet. The gripper contains a housing 31, a thread clamp 32 and an electromagnet 33. The housing 31 consists of a basic body 34 and of a cover part 35. The thread clamp 32 contains a guide member 36 for a weft thread, not illustrated, and a clamping part 37. The guide member 38 is of strip-like design and has an angled portion 38. The clamping part 37 is likewise of strip-like design and has an angled portion 39. The clamping part 37 is arranged so as to rest on the guide member 36, so that the angled portions 38, 39 form a V-shaped entry gap for a weft thread which is not illustrated. The electromagnet 33 has a U-shaped core 43 and a winding 40 and is arranged below the guide member 36 in such a way that the guide member 36 rests on the end faces of the legs of the core. In this embodiment, the guide member 36 consists of magnetically non-conductive material, whilst the clamping part 37 forms a magnet armature and consists of magnetically conductive material. The basic body 34 likewise has the connecting portion 11 for the transport unit. In this embodiment, a stop bar 41 is provided instead of the stop member.

In the embodiments described above, the actuator is in each case operated by induction. For this purpose, a primary induction coil 70, which is arranged outside the gripper, and a secondary induction coil 71, which is arranged in the housing 1, 21, 31 of the gripper, are provided. Also arranged in the housing are a current converter and amplifier 72 which are connected to the actuator via junction leads 52. An orifice 75 is provided in each case in the cover part 5, 25, 35.

Figure 4:
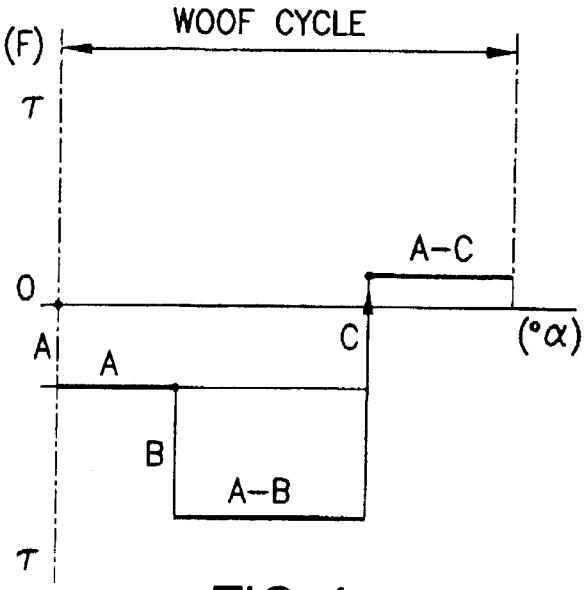
FIG. 4 shows a force/time diagram of the cycle of the thread-clamping action within one weft insertion.

Reference is made to FIG. 4. The following description is based on the embodiment according to FIG. 2. The figure shows a diagram with an abscissa for the angle of rotation of the main shaft of the weaving machine and with an ordinate for the clamping force. As shown in the figure, three operating positions, specifically holding A, clamping A+B and venting A−C, are defined for the thread clamp as a function of the angle of rotation. Each operating position is assigned a force A, B, C. The holding force A is exerted solely by the resilient element 26 and acts even when the weaving machine and the actuator are switched off. The weft thread to be inserted is first introduced into the open thread clamp and is subsequently subjected to the clamping force B generated by the actuator. The clamping of the weft thread takes place with force which is the sum of the forces A+B. The clamping force B is continuously adjustable up to the maximum, so as reliably to avoid weft thread losses. During the transfer of the weft thread from the feed gripper to the pick-up gripper, the actuators are reversed according to a control program, so that a venting force is generated which is the difference between the forces A−C. After the insertion operation has been concluded, the thread clamp, which is in the venting position, can be blown out. The operation described above applies to the feed gripper and also to the pick-up gripper with a contrary cycle.

Figure 5:
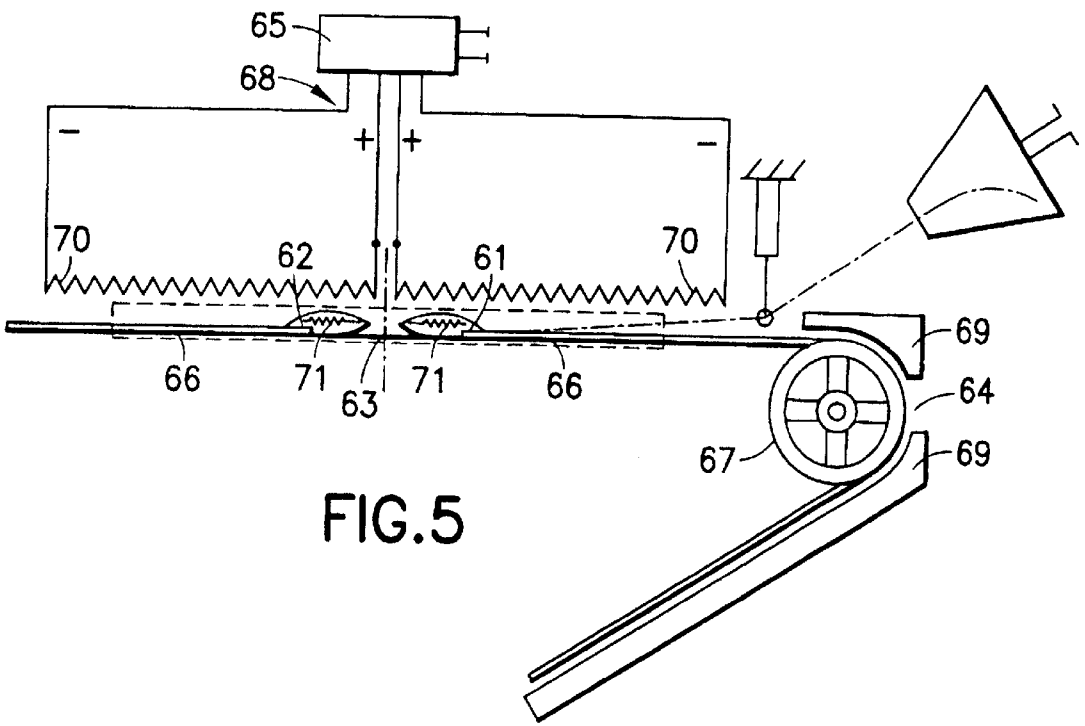
FIG. 5 shows an embodiment of a weft insertion device according to the invention.

FIG. 5 shows a weft insertion device with a feed gripper 61, a pick-up gripper 62, a transport unit 64 which conveys the feed gripper 61 and the pick-up gripper 62 in each case over the center 63 of the weaving width, and a device for operating the actuators. The transport unit 64 comprises a gripper head 66 with a guide 69 and a band wheel 67 which is drive-connected to a drive means not illustrated. The gripper band 66 consists of a flexible material, for example a composite plastic. The device for operating the actuators is arranged in the region of the thread transfer above the shed formed and on both sides of the center 63. The device contains two air-core transformers or commutators, which comprise a primary induction coil 70 and the secondary induction coil 71 arranged on the gripper 61, 62, and a control device 65 which is connected via leads 68 in each case to the primary induction coil 70, in order to control the primary induction coils as a function of the angle of rotation of the main shaft of the weaving machine and/or the textile or weaving data.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A gripper for a gripper weaving machine, comprising: a housing with a connecting portion connectable to a gripper band or a gripper rod; a thread clamp having a fixed clamping part and a moveable clamping part; an electrically operable actuator arranged in the housing and drive-connected to the moveable clamping part, in order to control a clamping force and a clamping cycle of the thread clamp, in the currentless state of the actuator the moveable clamping part being prestressed against the fixed clamping part by a holding force, the actuator being operable to change over from a clamping force acting in a direction of the holding force into a release force which counteracts the holding force and which is greater than the holding force, the actuator being operatively configured so that the magnitude of the clamping and release forces of the actuator are individually adjustable during an entire weaving cycle.

2. A gripper according to claim 1, wherein the actuator is an electromagnet.

3. A gripper according to claim 1, wherein the actuator is a piezoelectric element.

4. A gripper according to claim 1, and further comprising a device for operating the actuator, the device including a primary induction coil, and still further comprising a secondary induction coil arranged to cooperate with the primary induction coil, the actuator being connected to the secondary induction coil.

5. A weft insertion device for a gripper weaving machine, comprising: a feed gripper; a pick-up gripper, each of the grippers including a housing with a connecting portion connectable to a gripper band or a gripper rod, a thread clamp having a fixed clamping part and a moveable clamping part, an electrically operable actuator arranged in the housing and drive-connected to the moveable clamping part, in order to control a clamping force and a clamping cycle of the thread clamp, in the currentless state of the actuator the moveable clamping part being prestressed against the fixed clamping part by a holding force, the actuator being operable to change over from a clamping force acting in a direction of the holding force into a release force which counteracts the holding force and which is greater than the holding force, the actuator being operatively configured so that the magnitude of the clamping and release forces of the actuator are individually adjustable during an entire weaving cycle; a transport unit for the feed gripper and the pick-up gripper in order to move the grippers back and forth in translational motion; means for operating the actuator; and control means for controlling the actuator as a function of at least one of an angle of rotation of a main shaft and textile or weaving data.

* * * * *